United States Patent [19]

Rosentreter et al.

[11] 3,968,903

[45] July 13, 1976

[54] DUST WETTING APPARATUS

[75] Inventors: William O. Rosentreter, Norwalk; Richard M. Justice, La Mirada; Timothy E. Wade, Whittier, all of Calif.

[73] Assignee: Otto H. Rosentreter Co., Bell Gardens, Calif.

[22] Filed: Apr. 14, 1975

[21] Appl. No.: 567,758

[52] U.S. Cl. ..... 222/1; 222/57; 222/145; 222/413

[51] Int. Cl.[2] ..... B67D 5/14

[58] Field of Search ..... 222/57, 55, 54, 413, 222/145, 1

[56] References Cited

UNITED STATES PATENTS

| | | | |
|---|---|---|---|
| 1,569,201 | 1/1926 | Piersall | 222/57 |
| 2,102,584 | 12/1937 | Brown | 222/57 |
| 3,236,605 | 2/1966 | Pierson | 222/57 |
| 3,338,472 | 8/1967 | Gardner | 222/55 |

*Primary Examiner*—Allen N. Knowles
*Assistant Examiner*—Hadd Lane
*Attorney, Agent, or Firm*—Harris, Kern, Wallen & Tinsley

[57] ABSTRACT

A wetting apparatus and method for mixing water with a powdery dust generated from a foundry or other operation. In order to prevent dust from becoming airborne, and thus an environmental nuisance, it must be wetted before disposal. The wetting apparatus includes an elongated housing, a mixing screw, and a spray system in addition to inlet and outlet gates for metering the dust. The mixing screw load may be used to control water, while the weight of the dust itself may be used to meter its input into the housing. Alternatively, a moisture sensor or indicator for automatically controlling the quantities of dust and water may be used.

8 Claims, 9 Drawing Figures

DUST WETTING APPARATUS

BACKGROUND OF THE INVENTION

1. Field of the Invention

The present invention relates to an apparatus for wetting dust, and more particularly to an apparatus for mixing a dust-type product with water in an efficient and economical manner while at the same time conveying the wetted product to facilitate its disposal in an environmentally suitable manner.

2. Description of the Prior Art

The major problem with which this invention is concerned relates to the disposal handling of a dry dust-type product. Certain industries, such as the foundry industry, generate by virtue of their operation, a dry dust-type product. In the foundry, this dust product is commonly termed "fines", and it must be suitably disposed of. Metal castings are usually made by the process of pouring molten metal into a mold formed of sand. This sand generally consists of silica grains held together by some bonding material, usually clay or bentonite. The heat from the poured molten metal causes some of the sand to break apart into particles having a dust-like consistency. This dusty product is usually collected at the foundry in a dust collector and conveyed to a truck for hauling to a dump site. As is readily apparent, traditional bulk handling methods cause the dust to become airborne; this presents potential environmental nuisance problems for property owners adjoining the foundry and the dump site.

One solution to the handling problem is to mix the dust product with water, since most of the dust product has a relatively high clay content. Mixing with water causes the dust to form heavier and denser particles incapable of becoming easily airborne; this transformed product can then be handled in the more traditional manner without difficulty.

One system for mixing water with a dust product includes a large hopper where the dust is collected; the dust is then funneled through a bin having a unique geometric structure which is supposed to automatically feed the dust in a controlled manner to a conveyor system, the conveyor then delivers the product to a mixing location. A description of this bin is set forth in U.S. Pat. No. 3,399,466. Another system simply collects the dust in a large drum and within the drum are rotatable blades. A measured quantity of dust and water is simply introduced into the drum to be mixed. The drum is then emptied and a new batch is mixed. These systems are either too expensive or not sufficiently efficient.

It is also to be noted that in order to facilitate handling of the product after wetting, it is important that the right amounts of water and dust product are mixed. For example, insufficient mixing will still create airborne dust problems; too much water, on the other hand, will cause the product to coagulate or become soupy and thereby potentially overload the capacity of the handling system. In addition, a commercially viable system not be efficient, economical and reliable.

SUMMARY OF THE INVENTION

The present invention overcomes the problems mentioned above by providing an apparatus comprising in combination an elongated housing, an element within the housing for moving the product from an inlet to an outlet, the element being driven by a motor, and a spray system positioned to wet the product as it is moved along the housing. The housing includes an inlet opening and an outlet opening and the apparatus includes gates for metering the amount of dust input to the housing as well as the volume of dust within the housing. A moisture content indicator may also be used for optimization of the dust wetting process. Further, a simple coupling is provided between the product moving element and its motor.

It is a primary aim of the present invention to provide an efficient, effective and reliable system for mixing dust and water.

Another important aspect of the present invention is to provide a wetting apparatus which will be economical and simply constructed to enhance its commercial feasibility.

Yet another object of the present invention is to provide a wetting apparatus where the quantities of water and dust entering the system to be mixed are effectively controlled.

A further aspect of the invention is to provide an apparatus and method for metering the dust input and the output to insure the proper volume in the apparatus during wetting.

A further important aim of the invention is to achieve superior water spray coverage as well as to provide feedback on the moisture content of the product in the wetting apparatus.

The foregoing objects, advantages, features and results of the present invention, together will various other objects, advantages, features and results thereof which will be evident to those skilled in the art in the light of this disclosure, may be achieved with the exemplary embodiments of the invention described in detail hereinafter and illustrated in the accompanying drawings.

DESCRIPTION OF THE PREFERRED EMBODIMENT

Figure 1:
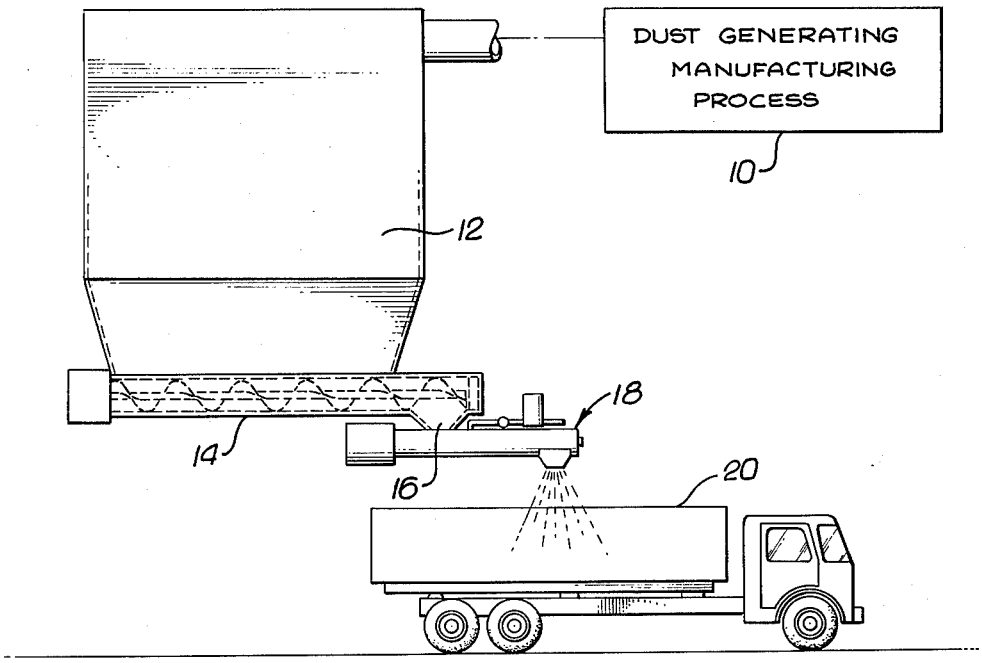
FIG. 1 is a diagrammatic elevational view of a dust collection system to which is mounted the wetting apparatus of the present invention.

While the present invention is susceptible of various modifications and alternative constructions, illustrative embodiments are shown in the drawings and will herein be described in detail. It should be understood, however, that it is not the invention to limit the invention to the particular forms disclosed; but on the contrary, the invention is to cover all modifications, equivalences and alternative constructions falling within the spirit and scope of the invention as expressed in the appended claims.

Referring now to FIG. 1, there is illustrated in diagrammatic form a dust-generating manufacturing process 10 such as a foundry operation. As explained hereinabove, a foundry operation requires the use of large quantities of sand as part of the metal casting manufacturing process. Once exposed to the high temperature of molten metal, such sand is broken down to dust-like particles and must be disposed of. Physically, the dust generated from a foundry operation has the consistency of a fine gray-colored powder. As mentioned, the problem is one of disposing of the dust-type product without becoming an environmental nuisance.

Referring once again to FIG. 1, there is illustrated a large hopper 12, usually referred to as a "bag house", into which the dust from the manufacturing process 10 is collected. The dust settles to the bottom of the hopper where it is conveyed by a screw conveyor 14 to an outlet 16. It is to be noted that the hoppe 12 could dump directly into apparauts 18 if so desired. Connected to this outlet is the inventive wetting apparatus 18 which will be described hereinbelow in detail. It is within the mixing apparatus that the dust is properly mixed with water and directed for facilitated disposal such as by discharging into a waiting open dump truck 20.

The bag house 12 and the conveyor 14 are the usual equipment found in a system to handle dust generated by a foundry process. A major advantage of the present apparatus is that it attaches easily to these and other existing dust-collection systems.

It is to be understood that while the present description relates to the problem of a dust-type product developed during the operation of a foundry, it can also be used to handle other dust-type products generated by or during other manufacturing processes.

Figure 2:
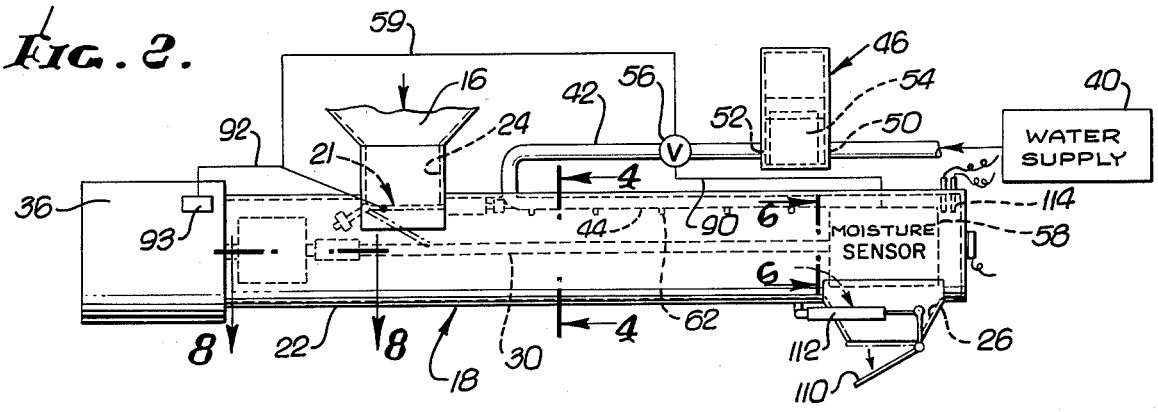
FIG. 2 is an enlarged diagrammatic elevational view of the inventive apparatus.

Referring to FIG. 2, the wetting apparatus 18 is comprised of an elongated housing 22 forming a passageway for the dust-type product between an inlet opening 24, which is attached to the outlet 16 of the conveyor 14 (FIG. 1), and an outlet opening 26. As shown in FIG. 1, the wetted product which is discharged through the outlet opening may be directly received by a dump truck. No intermediate handling is necessary.

Figure 4:
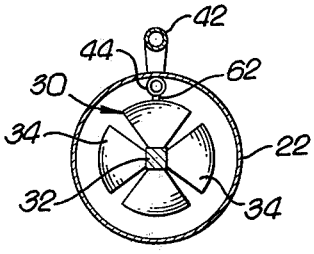
FIG. 4 is a diagrammatic cross-sectional view taken along lines 4—4 of FIG. 2.

Mounted within the inlet opening 24 is a latching-gate mechanism 21 for metering the incoming dust to the housing 22. Mounted within the housing 22 is means for moving the product along the housing and for mixing the product with water. Such means may be in the form of what is commonly referred to as a "mixing screw" 30, FIG. 4, comprising a square cross-sectioned shaft 32 and a series of radially extending, longitudinally spaced blades 34. The blades may have different forms (not shown), some blades being designed specifically to move the product longitudinally along the housing while other blades are specifically designed to facilitate mixing of the water and the dust product. Connected to the mixing screw and mounted to the housing 22 is a motor 36 for operatively rotating the mixing screw. As can now be readily understood, the arrangement just described has the advantage of simple construction, high reliability and commercial economy.

The latching-gate mechanism 21 is provided to meter the inflow of dust from the bag house 12. The gate may be triggered to open upon the accumulation of a predeterined amount of dust, by weight, and may also be operatively connected to the water supply so as to coordinate the dust and water inputs, all of which will be described in more detail hereinbelow relating to FIGS. 3 and 3*a*.

The wetting apparatus also includes a water system comprising a water supply 40, which may be an ordinary city water supply system, a piping arrangement 42 and a spray device 44. In series with the piping is a container 46 through which the water from the water supply must pass before entering the spray device. The container has a cylindrical shape with an inlet opening 50 and an outlet opening 52, located opposite one another and at the lower end portion of the cylinder. Within the container is a wetting agent 54 in cartridge form. The wetting agent is for the purpose of reducing the surface tension of the water so as to increase its "wetting" capacity. Thus, by reducing the surface tension of the water, its spreading and penetrating capability is increased. This means that the water exiting the outlet opening 52 will mix more easily and will more thoroughly wet the dust product than ordinary tap water which enters the inlet opening 50.

The flow of the water through the piping 42 is controlled by a valve 56 which may be connected to a moisture indicator 58. The moisture indicator will be described in more detail in relation to FIGS. 6 and 7.

Figure 3:
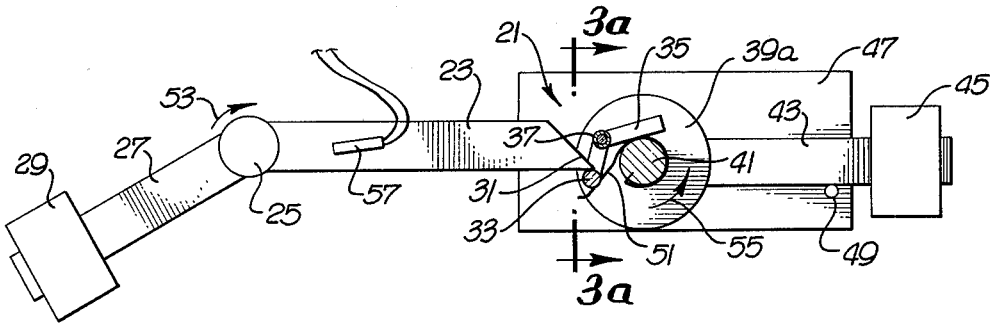
FIG. 3 is an enlarged diagrammatic front view of a gate and latching mechanism for metering incoming dust.
Figure 3A:
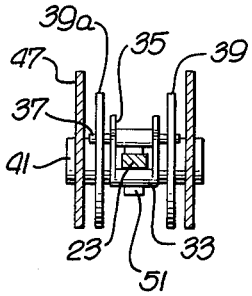
FIG. 3*a* is a side view of the mechanism of FIG. 3.

Referring now to FIGS. 3 and 3*a*, the gate-latching mechanism 21 is comprised of the gate 23 pivotally mounted to the inlet opening 24 by pivot shaft 25. Connected to the gate is an arm 27 having an adjustable counterweight 29. When the weight of dust above the gate is sufficient, the gate will pivot from the closed position shown in FIG. 2 to the open position also shown in FIG. 2. The gate has a finger portion 31 which, in a closed position, rests upon a pin 33. The pin 33 in turn is part of a bent arm 35 and is mounted to a pivot element 37 which in turn is attached to rotatable washers 39 and 39*a*. The washers are mounted to a shaft 41; arm 43 and adjustable counterweight 45 are attached to the washers. The weights 29 and 45 are adjustable by moving either along its respective arm; the further the weights are from their respective pivots, the more force is provided to prevent movement of the gate 23. The shaft is supported by a mounting plate 47 which in turn is attached to the housing 22. Attached to the plate is a stop pin 49. Placed around the shaft 41 is a spring 51 which bears against and braces the pin 33.

In operation, once the dust resting on top of the gate creates more of a force than that presented by the weights 29 and 45, the gate will pivot about the shaft 25 in a clockwise direction as shown by the arrow 53. This movement will cause the gate finger portion 31 to bear upon the pin 33 and rotate the washers 39, 39*a* in a counterclockwise direction as shown by the arrow 55. As rotation continues, the gate will slip off the pin and open completely. Once this happens, the spring 51 which has been distorted into a more biased position, will bias the pin 33 to its original position as shown where the upper part of the bent arm 35 abuts the shaft 41. Meanwhile, the weight 45 will cause the washers to rotate in a clockwise direction back to the position shown. The weight 45 which would have been raised during the counterclockwise movement of the washers will return to the generally horizontal position shown where it abuts the stop pin 49. An electrical mercury switch 57 may be attached to the gate 23 for operating the valve 56 and thus controlling the water input as a function of dust input. The connection between the switch 57 and the valve 56 is shown diagrammatically in FIG. 2 as line 59.

It is now appreciated that a reliable yet inexpensive arrangement has been disclosed for carefully yet automatically monitoring the amount of dust entering the housing so that optimum wetting is achieved. Further, the control of the water supply adds still a further dimension of control for optimization and resource conservation.

Figure 5:
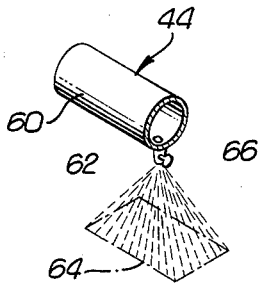
FIG. 5 is an enlarged diagrammatic perspective view illustrating an inventive spraying system with a nozzle for delivering a spray in a rectangular pattern.

Referring now to FIG. 5, the spray device 44 is illustrated in more detail and includes a main water delivery pipe 60 to which is attached an aligned series of nozzles such as the nozzle 62. These are designed to provide a rectangular spray coverage depicted by the rectangular region designated 64. For greater control purposes, valves, such as the valve 66 may be attached to each of the nozzles.

The portions of the apparatus described so far are relatively simply constructed so as to provide reliable and low-maintenance service. Further, because of the manner in which the system is designed, spray coverage of the product as the product is moved along the housing is excellent.

Figure 6:
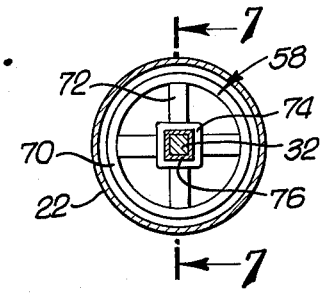
FIG. 6 is a diagrammatic elevational view taken along lines 6—6 of FIG. 2, illustrating the inventive moisture-sensing element.
Figure 7:
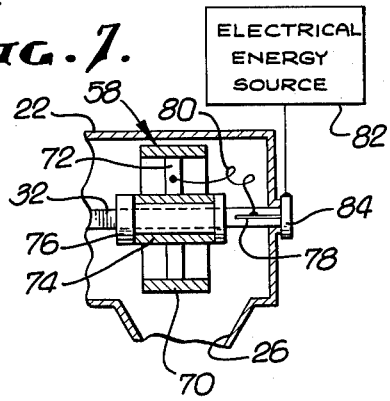
FIG. 7 is a diagrammatic elevational view of the moisture-sensing element taken along lines 7—7 of FIG. 6.

Referring now to FIGS. 6 and 7 in addition to FIG. 2, there is illustrated in more detail the moisture sensor or indicator 58 which is comprised of an annular rim 70. The rim is connected to a plurality of spokes such as the spoke 72 which in turn is attached to a square cross-sectioned hub 74. The hub 74 is slidably mounted to the square cross-sectioned shaft 32; however, placed between the shaft and the hub is an electrically insulative spacer 76. Formed in one end of the shaft 32 is a groove 78 within which rides one end of an electrically conductive element such as the wire 80. The other end of the wire is attached to the spoke 72. A source of electrical energy 82 is in communication with the shaft, such as through slip ring 84, though any other suitable arrangement can be used.

The moisture sensor is connected to the shaft near the outlet opening 26, FIG. 2, so that it may monitor the moisture content of the product after the product has been sprayed. Because the electrical resistance of the wetted product varies as a function of its moisture content, the moisture content can easily be determined by measuring the relative resistance in any convenient manner, i.e., by measuring current or voltage. Another way in which moisture can be sensed is to monitor the amperage requirement of the motor 36. This is illustrated by box 93, FIG. 2. The greater the product volume, the greater the load on the motor, hence the greater the amperage. Thus, such a monitor 93 may be connected to the valve 56, as shown by line 92 to control the water input.

By connecting the gate-latch mechanism 21, and/or the motor monitor 92 and/or the moisture sensor 58 to the valve 56 (the latter as depicted in the drawing by the line 90, FIG. 2), one can control the amount of water being sprayed onto the product. For example, if the moisture level is too low, the valve 56 is more fully opened to cause a greater flow of water through the piping 42. In an opposite situation, if the moisture level is too high, then the valve 56 is operated to restrict the flow of water. As mentioned, the flow of dust product can also be restricted or eased in the same manner as the flow of water; this allows for the optimum range of material and water to be mixed, the range being a function primarily of the nature of the dust product. Preferably, either the dust flow or the water flow is kept constant while the other is varied to achieve optimum operation. Nevertheless, whichever mode of operation is chosen, it is clear that the system offers an efficient and effective manner for mixing water with a dust product. And, because of the control system, there is good quality control which insures reliable operation.

Figure 8:
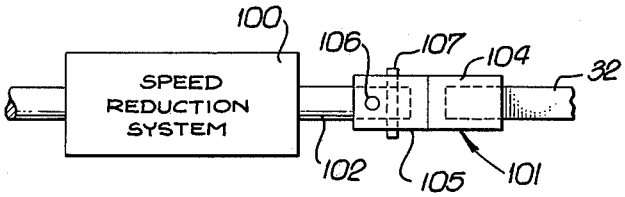
FIG. 8 is a diagrammatic elevational view illustrating a coupling, taken generally along lines 8—8 of FIG. 2.

Referring now to FIGS. 2 and 8, there is illustrated in greater detail a coupling apparatus for transmitting the rotational motion from the motor 36 to the square cross-sectioned shaft 32. In the usual manner, the shaft (not shown) from the motor 36 acts as an input of a speed reduction system 100 which in turn has a cylindrically shaped output shaft 102. In order to connect the cylindrical output shaft 102 and the square cross-sectioned shaft 32 of the mixing screw, a coupling element 101 having a square tubular element 104 welded end to end to a round tubular element 105 is provided. The element 104 is slipped over the shaft 32 while the element 105 is connected to the shaft 102 by two bolts 106, 107 disposed at right angles to each other. Once again, the advantage achieved is that the coupling element 101 is inexpensive, simply constructed, yet highly reliable in operation.

Finally, connected to the outlet opening 26 is a gate 110, FIG. 2, movable between opened and closed positions by an air piston cylinder mechanism 112. It has been found that when operating the apparatus 18 in a fairly full condition, i.e., having the dust occupy ⅔ to 4/5 by volume of the housing 22, mixing and wetting are optimized. To achieve the desired bulk of dust in the housing, an electrical sensor 114 is positioned near the end of the housing and is operatively connected in a manner well-known by those skilled in the art to the air apparatus 112. When the wetted dust contacts the sensor, a circuit is closed and the gate 110 is opened. As the wetted dust is discharged through the outlet opening 26, the sensor will no longer be in contact with the dust and the gate 110 closes, thereby allowing the dust to build up again.

In operation, the dust collected in the bag house is received by the housing 22 through its inlet opening 24. Thereafter, it is transported longitudinally by the mixing screw 30 to the outlet opening 26. While being transported, water which has been treated with a wetting agent is sprayed on the dust in order to increase particle size and particle density. In order the achieve optimum wetting results, the dust is metered through the gate-latch mechanism 21 as a function of weight while the wetting water is metered through the valve 56 which may be controlled in response to the opening of the gate-latch mechanism and/or the load on the screw motor 36. For example, when handling foundry dust at a volume rate between 5 and 10 tons per hour, the gate-latch mechanism opens when the weight of the dust exceeds 5 pounds. Water flow is controlled as a function of motor load. With a 7½ horsepower motor, water flow is 2.5 gallons per minute when the motor is drawing 6.0 amps and 10 gallons per minute when the motor is drawing 6.5 amps. To increase effectiveness of the system, controllable nozzles may be used to more evenly and fully direct the water spray. Meanwhile, the gate 110 is selectively opened and closed to insure a relatively full housing. It is to be noted that the moisture indicator may also operate the gate 110 as well as the valve 56. Thus, if the dust is easily wetted, the gate may be opened sooner and/or the water input may be reduced.

Obviously, many modifications and variations of the present invention are possible in the light of the above teachings. It is therefore to be understood that the invention may be practiced otherwise than as specifically described.

What is claimed is:

1. A wetting apparatus comprising in combination:

an elongated housing forming a passageway for a finely granulated product to be wetted, said housing having an inlet opening for receiving said product and an outlet opening through which said product may be discharged;

means mounted within said housing for moving said product from said inlet opening to said outlet opening and for mixing;

means connected to said housing and said moving means for operating said moving means;

means connected to said housing and communicating with a supply of water for allowing said product to be sprayed with water;

a gate connected to said housing for variably blocking the outlet opening thereby allowing the volume of said product to be controlled; and a moisture sensor operatively connected to said gate to control the blocking by said gate of said outlet opening.

2. An apparatus as claimed in claim 1 including a gate-latch mechanism connected to said housing for selectively blocking the inlet opening.

3. An apparatus as claimed in claim 2 wherein said gate-latch mechanism is weight responsive.

4. An apparatus as claimed in claim 3 wherein said gate-latch mechanism is comprised of two pivotal arms each having a weighted element movable therealong.

5. An apparatus as claimed in claim 1 wherein:

said moisture sensing means comprises an annular electrically conductive element adapted to be mounted to a rotatable shaft; and means in electrical communication with said annular element for providing electrical energy thereto.

6. An apparatus as claimed in claim 1 wherein:

said operating means is a motor;

said moving means includes a shaft having a square cross section; and including means for transmitting the rotational motion of said motor at a reduced speed to said shaft; and a tubular coupling having a round portion and a square-shaped portion attached to said motion transmitting means and mounted on said shaft.

7. An apparatus as claimed in claim 1 wherein:

said spray causing means includes a pipe and a wetting agent container mounted to said pipe;

said wetting agent container being located between a water supply and a control valve which are also mounted to said pipe; and including said control valve.

8. A method for wetting dust comprising providing a housing having an inlet opening and an outlet opening;

providing a mixing screw and a motor for driving said screw, said screw being placed in said housing;

selectively blocking said inlet opening for metering the input of dust, said metering being a function of dust weight;

selectively introducing water into said housing; and variably blocking said outlet opening in accordance with the wetness of said dust.

* * * * *